US009671078B2

(12) United States Patent
Cabanne et al.

(10) Patent No.: US 9,671,078 B2
(45) Date of Patent: Jun. 6, 2017

(54) LIGHTING UNIT FOR A MOTOR VEHICLE

(71) Applicant: Valeo Iluminacion, Martos (ES)

(72) Inventors: Damien Cabanne, Martos (ES); Alberto Rodriguez-Fuentes, Jaen (ES); Jose Castillo Jimenez, Martos (ES)

(73) Assignee: Valeo Iluminacion, Martos (ES)

( * ) Notice: Subject to any disclaimer, the term of this patent is extended or adjusted under 35 U.S.C. 154(b) by 102 days.

(21) Appl. No.: 14/663,709

(22) Filed: Mar. 20, 2015

(65) Prior Publication Data

US 2015/0267886 A1 Sep. 24, 2015

(30) Foreign Application Priority Data

Mar. 21, 2014 (FR) ..... 14 52364

(51) Int. Cl.

| | |
|---|---|
| ***F21V 7/09*** | (2006.01) |
| ***F21S 8/10*** | (2006.01) |
| *F21W 101/10* | (2006.01) |
| *F21Y 101/00* | (2016.01) |

(52) U.S. Cl.

CPC ..... *F21S 48/1159* (2013.01); *F21S 48/14* (2013.01); *F21S 48/321* (2013.01); *F21S 48/328* (2013.01); *F21W 2101/10* (2013.01); *F21Y 2101/00* (2013.01)

(58) Field of Classification Search

CPC ..... F21S 48/14; F21S 48/1376; F21S 48/1784
See application file for complete search history.

(56) References Cited

U.S. PATENT DOCUMENTS

| | | | | |
|---|---|---|---|---|
| 7,635,206 | B2 | 12/2009 | Huang | |
| 7,866,863 | B2 * | 1/2011 | Tanaka | F21S 48/1388 362/296.05 |
| 8,579,484 | B2 * | 11/2013 | Sugie | F21S 48/1159 362/294 |
| 8,721,130 | B2 | 5/2014 | Uchida | |
| D709,226 | S | 7/2014 | DiPenti et al. | |
| D712,079 | S | 8/2014 | DiPenti et al. | |
| 8,801,247 | B2 | 8/2014 | Sugie et al. | |

(Continued)

FOREIGN PATENT DOCUMENTS

| | | | |
|---|---|---|---|
| DE | 102011084890 | A1 | 4/2013 |
| DE | 102012109492 | A1 | 4/2014 |

(Continued)

*Primary Examiner* — Andrew Coughlin
*Assistant Examiner* — Keith Delahoussaye
(74) *Attorney, Agent, or Firm* — Jacox, Meckstroth & Jenkins

(57) ABSTRACT

A lighting unit including devices for emitting a luminous flux in the direction of a reflector featuring devices for optical deflection of the flux toward the outlet of the unit, the reflector including a support wall that is fastened to the optical deflection devices and is disposed across the optical deflection devices so as to be disposed between the optical deflection devices and the emission devices.

The support wall includes a masking portion that is disposed facing the emission devices and a so-called cut-off edge of which is cut away so as to form a mask integral with the support wall adapted to allow to pass only a portion of the rays emitted by the emission devices. The invention also concerns a motor vehicle headlamp, notably in that it includes two lighting units disposed transversely side by side.

19 Claims, 2 Drawing Sheets

(56) References Cited

U.S. PATENT DOCUMENTS

| | | | | |
|---|---|---|---|---|
| 8,820,993 | B2 * | 9/2014 | Kloos | F21S 48/145 362/509 |
| 8,845,161 | B2 | 9/2014 | DiPenti et al. | |
| 8,967,841 | B2 | 3/2015 | Bohm | |
| 8,967,843 | B2 | 3/2015 | Jackl et al. | |
| 2005/0122734 | A1 * | 6/2005 | Foust | B60Q 1/14 362/539 |
| 2009/0168428 | A1 | 7/2009 | Huang | |
| 2009/0251916 | A1 * | 10/2009 | Tanaka | B60Q 1/04 362/538 |
| 2009/0284980 | A1 * | 11/2009 | Iwasaki | F21S 48/1159 362/517 |
| 2011/0199778 | A1 * | 8/2011 | Okubo | F21S 48/1159 362/539 |
| 2011/0249461 | A1 | 10/2011 | Sugie et al. | |
| 2011/0280028 | A1 | 11/2011 | Uchida | |
| 2012/0201043 | A1 | 8/2012 | DiPenti et al. | |
| 2013/0027958 | A1 * | 1/2013 | Okubo | F21S 48/1159 362/512 |
| 2013/0039085 | A1 | 2/2013 | Iwasaki et al. | |
| 2013/0070469 | A1 | 3/2013 | Sugie | |
| 2013/0215632 | A1 | 8/2013 | Jackl et al. | |
| 2013/0235605 | A1 | 9/2013 | Bohm | |
| 2014/0369062 | A1 | 12/2014 | DiPenti et al. | |

FOREIGN PATENT DOCUMENTS

| | | | |
|---|---|---|---|
| EP | 2386795 | A1 | 11/2011 |
| EP | 2551581 | A2 | 1/2013 |
| EP | 2557357 | A2 | 2/2013 |
| EP | 2573456 | A1 | 3/2013 |
| WO | 2014080747 | A1 | 5/2014 |

* cited by examiner

LIGHTING UNIT FOR A MOTOR VEHICLE

CROSS-REFERENCE TO RELATED APPLICATIONS

This application claims priority to French Application No. 1452364 filed on Mar. 21, 2014, which application is incorporated herein by reference and made a part hereof.

BACKGROUND OF THE INVENTION

1. Field of the Invention

The present invention concerns a lighting unit including devices for emitting a luminous flux in the direction of optical deflection devices for orienting the flux towards an outlet face of the unit. It more particularly concerns such a lighting unit further including a mask adapted to block a portion of the luminous flux, disposed between the emission devices and the optical deflection devices. These light emission devices are light sources.

2. Description of the Related Art

In lighting units of this type, the role of the mask is to block the unwanted rays of the luminous flux emitted by the emission devices in order for only a narrow and targeted beam to enter the optical deflection devices, so that on the one hand the rays are reflected correctly therein toward the outlet face of the unit and on the other hand no ray is reflected at adjoining walls delimiting these optical deflection devices.

It is clear that, for a given lighting unit, the position of the mask between the light emission devices and the optical deflection devices must be determined with precision and that the shape of the mask must be a function of the shape of the optical deflection devices, for the mask to be able to block the first rays deemed unwanted and to allow to pass the rays of the narrow beam directed towards the optical deflection devices. Particular attention is then paid to the machining of the mask and to the devices for positioning this mask relative to the light emission devices.

Moreover, the shape of the optical deflection devices varying from one vehicle to another, there is a provision for associating locating means with the lighting units to prevent the wrong mask being associated with the optical deflection devices, the effect of which would be either not to fulfill correctly the function of blocking unwanted rays or to block a portion of the flux correctly directed toward the optical deflection devices and therefore to limit the lighting efficacy of the lighting unit.

SUMMARY OF THE INVENTION

The invention aims to propose a lighting unit adapted to allow great precision in the shape and the positioning of the mask present in the unit.

The lighting unit in accordance with the invention is intended to include devices for emitting a luminous flux in the direction of a reflector featuring devices for optical deflection of the flux toward the outlet of the unit, the reflector including a support wall that is fastened to the optical deflection devices and is disposed across the optical deflection devices so as to be disposed between the optical deflection devices and the emission devices. The support wall includes a masking portion that is disposed facing the emission devices and an edge of which is cut away so as to form a mask integral with the support wall adapted to allow to pass only a portion of the rays emitted by the emission devices.

Producing the mask directly in the support wall, carrying the optical deflection surface and the initial function of which is to stiffen the reflector, is notably advantageous in that it results from integration rather than from assembling a separate part, which represents a saving in terms of the separate part and the associated locating means, and allows precision in the disposition of the functional areas relative to each other, thereby avoiding the multiplication of manufacturing and assembly play. In accordance with one embodiment the reflector and the support part are integral in one piece. The reflector, the support part and the mask thus form a single one-piece part.

In accordance with various features of the invention, taken separately or in combination, the position and the shape of the cutaway edge are varied to optimize the blocking of the unwanted rays.

For example, the edge is adapted to block rays that would not be oriented toward the optical deflection devices.

These optical deflection devices may be sections of reflecting surface adapted to form a portion or the whole of a lighting and/or signaling beam by means of the rays that they reflect. In this case it is particularly beneficial to block rays going toward a reflecting surface separate from these optical deflection devices, for example an aluminized portion the shape of which is aesthetically pleasing but has no part to play in the formation of the beam. In fact, if they were not blocked, these rays would be reflected in unwanted directions. For example, in the context of a beam with a cut-off, such as a low beam, these rays could pass above the cutaway and dazzle drivers approaching in the opposite direction.

The lighting beam obtained by means of the rays reflected by the optical deflection devices, can for example be a high beam, a low beam or a fog beam. In the context of a signaling beam, this may for example be from a brake light, a parking light used at night or a parking light used during the day.

The unit in accordance with the invention can therefore have one or more of the following features:

the masking portion is disposed transversely at the center of the support wall;

the masking portion lies in a plane offset vertically, in the direction away from the emission devices, relative to the rest of the support wall; this direction may correspond to the overall direction of emission of the devices for emitting a luminous flux, this overall emission direction corresponding to the mean direction around which the light rays are distributed.

the support wall is disposed across the optical deflection devices so as to leave a passage between the optical deflection devices and a rear edge of the support wall, and the edge of the masking portion, which is corrugated, extends at these transverse ends in continuity with the rear edge of the support wall, which is straight;

the reflector includes a frame for supporting the optical deflection devices that includes at least one wall delimiting these optical deflection devices, and the edge of the masking portion is cut away to correspond to a given position of this wall delimiting the optical deflection devices;

the edge of the masking portion is cut away and arranged so as to receive light rays emitted directly by the light source and that without this edge would be outside the optical deflection devices; in accordance with one embodiment, the points defining the edge of the masking portion, the points delimiting the edge of the surfaces of the optical deflection devices and at least one point of the source are aligned;

the edge of the central section has a corrugated shape;

the walls delimiting the optical deflection devices include two walls that delimit the optical deflection devices laterally on either side and are joined perpendicularly to the support wall and a lower wall that is joined to the lower edge of the optical deflection devices, opposite the support wall, and the masking portion has two lateral sections in which the edge of the masking portion extends in transverse continuity with the rear edge of the support wall and a central section offset longitudinally toward the interior of the support wall. The edge of this central section may have a corrugated shape, the corrugated shape of the edge of the central section possibly being a function of the shape of the line joining the lower edge of the optical deflection devices and the lower wall of the support frame.

In accordance with another feature of the invention, the support wall carries means for positioning the light emission devices. The correct positioning of the emission devices relative to the mask carried by the support wall is therefore achieved.

These positioning means may be integral with the support wall and moreover include a pin projecting from the support wall for adjustment of the position of the light emission devices relative to the unit in two perpendicular directions parallel to the plane of the support wall. In this case, the positioning means further include a stop projecting from the support wall for the adjustment in a third direction perpendicular to the first two directions, the height of the stop relative to the support wall being less than that of the pin.

In accordance with one feature of the invention, the lighting unit may have, on the support wall, means for fixing a heatsink adapted to cover the emission devices to cool same. In this case, the fixing means may be disposed at one transverse edge at least of the support wall while the positioning means are disposed in the vicinity of the masking portion or between the latter and the fixing means.

In accordance with one embodiment, the lighting unit includes light emission devices.

In accordance with one embodiment, the light emission devices are supported directly or indirectly by the support wall, notably via a printed circuit board, or for example via an element carrying the printed circuit board.

The invention also concerns a motor vehicle headlamp including two lighting units as just described hereinabove and in which the two units are disposed transversely side by side.

BRIEF DESCRIPTION OF THE ACCOMPANYING DRAWINGS

Other features and advantages of the invention will become apparent on reading the following detailed description of one embodiment and for the explanation of which reference will be made to the appended drawings, in which.

DETAILED DESCRIPTION OF THE PREFERRED EMBODIMENTS

Hereinafter, by longitudinal direction L is meant the direction of movement of the motor vehicle and by transverse direction T is meant a horizontal direction perpendicular to this longitudinal direction. By vertical direction V is meant the direction perpendicular to the preceding two, which moreover define a horizontal plane. The trihedron L,V,T is shown in the figures to facilitate reading them. However, it will be clear that the lighting unit can be arranged in some other orientation without departing from the scope of the invention.

Figure 1:
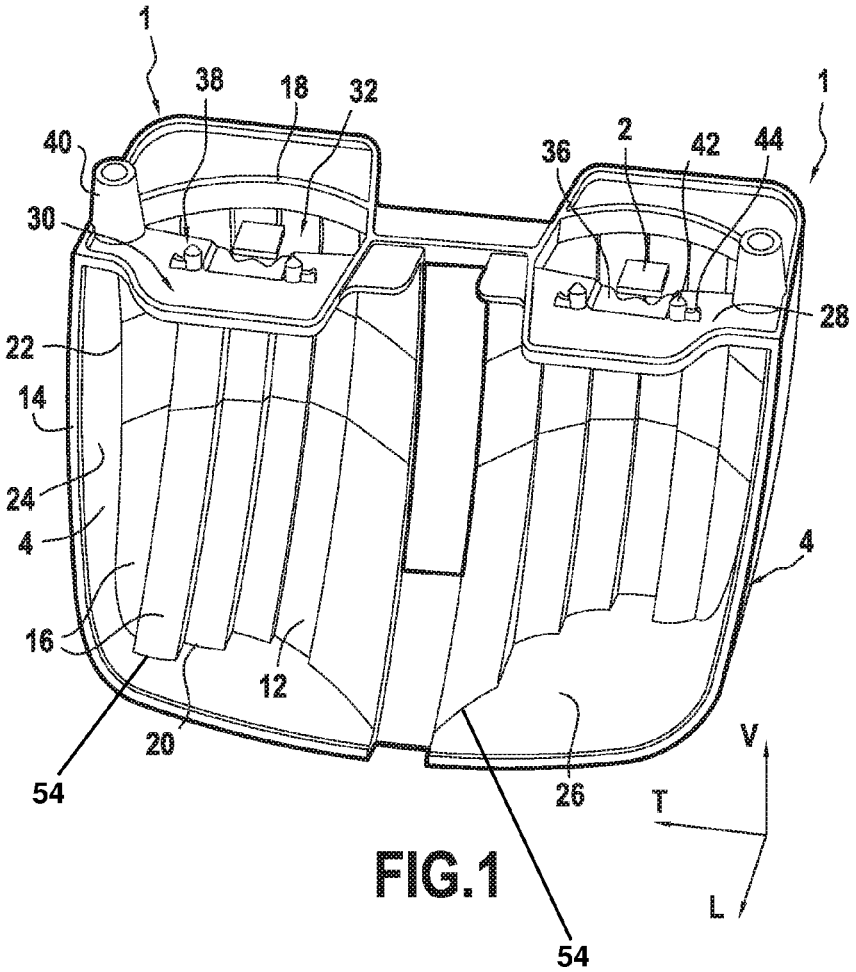
FIG. 1 is a perspective view of a reflector of a lighting unit in accordance with the invention, in which a mask is integral with a support wall fastened to the reflector forming devices for optical deflection of a light beam emitted by a light source, the light source being represented suspended, without its fixing support, which is not represented here to make the mask easier to see.
Figure 3:
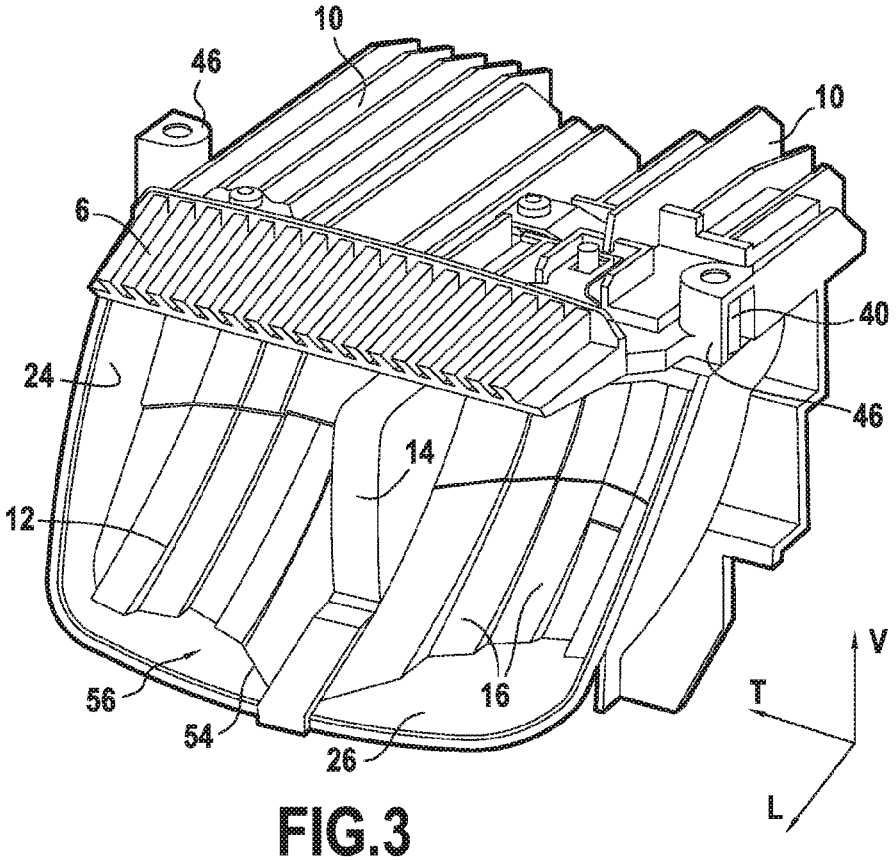
FIG. 3 is a general view of a lighting unit in accordance with the invention in which the fixing support of the light source mounted on the reflector is shown this time.

In the embodiment shown, notably visible in its entirety in FIGS. 1 and 3, a motor vehicle headlamp includes two units disposed side by side. The following description details the structure of one unit and it is clear that it could apply to each of the units.

A lighting unit 1 light includes emission devices 2 for emitting a luminous flux and a reflector 4 facing which are disposed the emission devices 2, which are adapted to concentrate the flux emitted toward an outlet face of the lighting unit 1, not represented here. The lighting unit 1 further includes heat exchange devices 6 formed by a heatsink mounted on the reflector 4.

Here the light emission devices 2 include a printed circuit board supporting a light-emitting diode 8. The light-emitting diode 8 is adapted to emit targeted light rays in the direction of the reflector 4, on the basis of an electrical command instruction transmitted by the printed circuits. As can be seen in the embodiment shown in FIG. 4, the light emission devices 2 may be carried by an interchangeable modular element 10 to one of the faces of which the printed circuit board is fastened and that is adapted to be fixed in a recessed housing in the heatsink, so that the face carrying the light-emitting diode 8 faces toward the reflector 4. The modular element 10 therefore facilitates the manipulation of the light-emitting diode 8 when it is failing in order to replace it with a new diode.

The reflector 4 includes optical deflection devices 12 and a support frame 14 that notably allows the reflector 4 to be fixed into the lighting unit 1.

The optical deflection devices 12 take the form of a substantially elliptical collector that includes a reflective internal surface. As can notably be seen in FIGS. 1 and 4, the reflecting internal surface of the collector need not be perfectly elliptical and may include one or more strips 16 with specific or complex profiles in order to optimize the distribution of light in the lighting beam. The transverse assembly of these strips 16 forms a substantially elliptical general shape so that the collector has a first focus, at which the aim is to place the light-emitting diode 8 as precisely as possible, and a second focus at which the outlet face of the lighting unit 1 is located.

The collector is delimited in a vertical dimension by an upper edge 18 and a lower edge 20 and in a transverse dimension by lateral edges 22. The upper edge 18 of the collector has a substantially elliptical profile while the lower edge 20 of the collector has a stepped profile, which can vary from one lighting unit 1 to another, as can notably be seen in FIG. 1.

The support frame 14 includes at least one upstanding wall 24 laterally flanking the collector, a substantially horizontal lower wall 26 that is connected to the lower edge 20 of the collector, and a support wall 28 fastened to the upper edge of the upstanding wall 24 and that extends across the collector, substantially parallel to the lower wall 26 so as partially to cover the collector.

The walls 24, 26, 28 of the support frame 14 are coated with aluminum, notably for aesthetic reasons. These walls 24, 26, 28 have no light ray reflection function but only the function of stiffening the lighting unit 1. Accordingly, as described in more detail hereinafter, the aim is to direct as many as possible of the emitted light rays toward the reflecting surface of the optical deflection devices 12 that is adapted to enable correct orientation of the light rays at the outlet of the lighting unit 1 and to block any unwanted rays directed toward these aluminum walls 24, 26, 28 of the support frame 14.

The support wall 28 is substantially plane. It has a lower face facing toward the collector and an opposite upper face 30. As can be seen in FIG. 1, the support wall 28 is disposed across the reflector 4 so that an upper opening 32 is provided between a rear edge 34 of the support wall 28, which extends transversely, and the upper edge 18 of the collector, the upper edge 18 being referred to as the rear edge 34 in the sense of the general light emission direction and the direction of this emission toward the outlet of the lighting unit 1, toward the front of the vehicle.

In accordance with the invention the support wall 28 includes a masking portion 36 that is disposed substantially at the center of the support wall 28 in the transverse dimension. In the embodiment shown, the masking portion 36 is further distinguished from the rest of the support wall 28 in that it has a vertical recess recessed into the upper face 30 of the support wall 28. This vertical recess, as can particularly be seen in FIG. 2, does not necessarily extend the whole longitudinal dimension of the support wall 28, but originates at the level of the rear edge 34 of the support wall 28.

The support wall 28 carries on its upper face 30 in the vicinity of the masking portion 36 positioning means 38 adapted to cooperate with the light emission devices 2 and also carries on its upper face 30, this time at one of its transverse edges at least, fixing means or posts 40 for fixing it to the heatsink.

The positioning means 38 take the form of two pairs respectively formed of a pin 42 and a stop 44, these pairs being disposed transversely on either side of the masking portion 36.

The pin 42 has a part-conical shape that projects from the support wall 28 to fit in the light emission devices 2, in which a bore of complementary conical shape has been drilled. The pin 42 is therefore adapted to locate the light emission devices 2 in two directions, transverse and longitudinal, relative to the support wall 28 and therefore relative to the masking portion 36.

The stop 44 is disposed in the vicinity of the pin 42 and projects to a lower height than the pin 42, to enable the light emission devices 2 to rest vertically on the upper face 30 of the stop 44 when they cooperate with the adjacent pin 42. The stop 44 is therefore adapted to enable location of the light emission devices 2 in the third direction.

The fixing means take the form of posts 40 that project substantially perpendicularly from the support wall 28. These posts 40 may be integral with the support wall 28 or mounted thereon. They are adapted to cooperate with complementary fixing means 46 that are carried by the heatsinks and can be seen in FIG. 4.

The masking portion 36 serves as a mask, formed directly in the support wall 28, and is distinguished from the support wall 28, apart from its vertical recess in the embodiment shown, essentially by the particular profile of its edge 48, which is corrugated, in contrast to the straight rear edge 34 of the support wall 28 extending transversely on either side of the masking portion 36.

The corrugation of the profile of the edge 48 of the masking portion 36 is different according to each lighting unit 1 and the shape of the optical deflection devices 12. It is nevertheless clear that the profile of the edge 48 of the masking portion 36 advantageously has two lateral sections 50 that extend substantially in transverse continuity with the rear edge 34 of the support wall 28 and that lie on either side of a central section 52 offset longitudinally toward the interior of the support wall 28.

Figure 2:
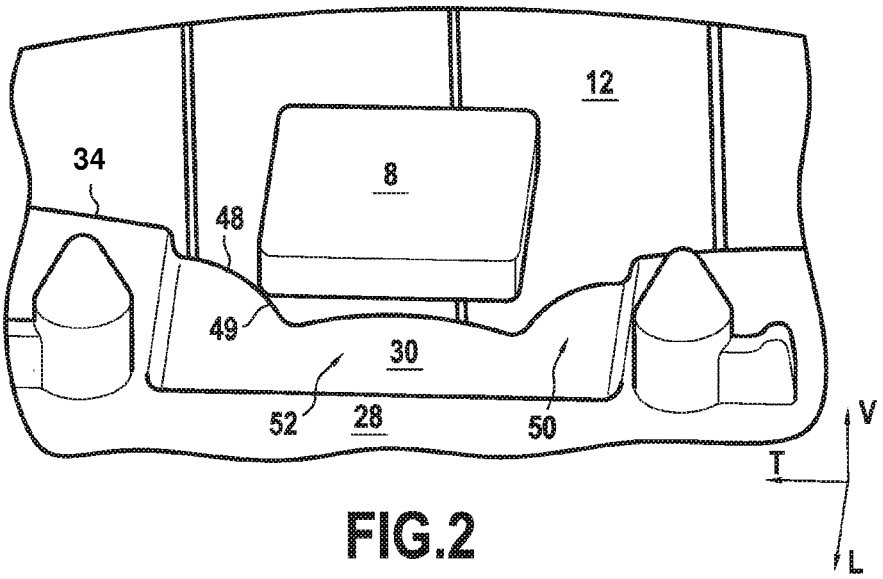
FIG. 2 is a perspective view of a detail from FIG. 1.

This particular shape of the profile is obtained by removal of material in the central part of the masking portion 36 so as to form transversely two lateral areas that lie on either side of a central area, of smaller longitudinal size. The longitudinal junction 49 between each lateral area and the central area may be straight or substantially inclined relative to the longitudinal direction, as can be seen in FIG. 2.

The function of the lateral areas of the masking portion 36 is to block any unwanted rays directed toward the upstanding walls 24 of the reflector 4, while the function of the longitudinal clearance formed by the central area is on the one hand, in the clearance area, to allow the passage of the emitted rays in the direction of the optical deflection surface, and on the other hand to block by means of the edge 48 of the masking portion 36 the first unwanted rays directed toward the joining line 54 between the lower edge 20 of the collector and the lower wall 26 of the support frame 14 of the reflector 4.

It is clear that the corrugation of the profile of the edge 48 of the masking portion 36 is made to correspond to the shape of this joining line 54. In the example shown, as can be seen in FIGS. 1 to 3, the profile of the edge 48 in the central area is convex, to correspond to the longitudinal recess 56 formed substantially at the center of the joining line 54, visible in FIG. 3.

Figure 4:
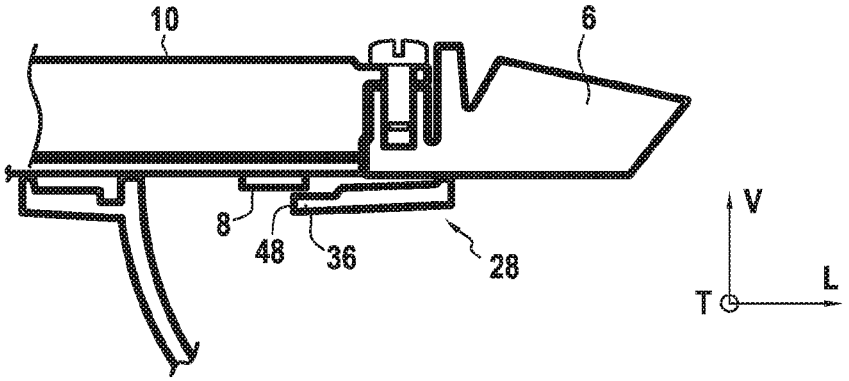
FIG. 4 is a view in longitudinal section of the unit from FIG. 3.

How to produce and assemble the various components described above of the lighting unit 1 in accordance with the invention as can be seen in FIG. 4 is described next.

Firstly, the reflector 4 as shown in isolation in FIG. 1 is produced. The support frame 14 and the optical deflection devices 12 are fastened together and the support frame 14 carries the positioning means 38 and the fixing means or posts 40 integral with the support wall 28, which further includes the masking portion 36. It is clear that it is therefore the machining of only this part that needs to be precise in order to ensure that the dimensions of the fixing means or posts 40 and the masking portion 36 match up.

The heat exchange devices 6 are mounted on the support frame 14, through the cooperation of the fixing means or posts 40 fastened to the support frame 14 and complementary fixing means 46 carried by the heat exchange devices 6. The latter therefore cover the upper opening formed between the support wall 28 and the upper edge 18 of the collector.

The light emission devices 3 are mounted on the interchangeable modular elements 10 and the latter are fastened to the heatsink in a position such that the light-emitting diode 8 is disposed substantially at the first focus of the elliptical collector.

This position is achieved by mounting the modular element 10 in the heat exchange devices 2 and by having the interchangeable modular element 10, or more directly the printed circuit board carried by this modular element 10, cooperate with the positioning means 38. A sliding mounting of the modular element 10 in the heat exchange devices 2 may be used to allow for any assembly play.

In this position, in which the light-emitting diode 8 is disposed substantially at the first focus of the collector, the light-emitting diode 8 is able to emit a luminous flux toward the optical deflection devices 12, with the masking portion 36 that is disposed in part on the path of the emitted rays, between the light-emitting diode 8 and the optical deflection devices 12.

The masking portion 36 is therefore disposed on the path of the luminous flux, directly at the outlet of the light-emitting diode 8, before any reflection of these rays and the edge of the masking portion 36 is correctly positioned to sort the unwanted rays from this flux, which are blocked by the masking portion 36, from the rays correctly directed toward the optical deflection devices 12, which pass through the longitudinal clearance formed by the cutting of the light cut-off edge.

The masking portion 36 features a vertical recess as described above and it is seen that in the assembled lighting unit 1 this recess is in the direction away from the light emission devices 2.

Assembled in this way, the lighting unit 1 can be fixed to the structure of the vehicle to form all or part of a headlamp of this vehicle. As shown in the figures, the lighting unit 1 is disposed so that the support wall 28 is horizontal and so that the lateral walls of the support frame 14 are substantially vertical, but it will be clear that the general orientation of the lighting unit 1 could vary, without departing from the scope of the invention, as a function of its final application.

The foregoing description explains clearly how the invention enables the objectives set for it to be achieved and notably the objective of proposing a lighting unit 1 which, with means that are simple to manufacture and assemble and are of low unit cost, control the diffusion of unwanted light toward areas intended to reflect light.

Of course, various modifications may be made by the person skilled in the art to the structures of the lighting unit 1 that have just been described by way of nonlimiting example, provided that the mask is integral with a wall of the support frame of the reflector, and provided that the mask is disposed between the luminous flux emission devices and the optical deflection devices of a lighting unit 1.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A lighting unit comprising:

a reflector; and emission devices for emitting a luminous flux in the direction of said reflector, said reflector comprising optical deflection devices for optical deflection of said flux toward an outlet of said lighting unit, said reflector including a support wall disposed across said optical deflection devices so as to be disposed between said optical deflection devices and said emission devices, said support wall including a masking portion that is disposed facing said emission devices and an edge of which is cut out so as to form a mask integral with said support wall adapted to allow to pass only a portion of the rays emitted by said emission devices, said masking portion being integrally formed in said support wall and having a cut-off edge that is adapted to block rays that are oriented or directed outward said optical deflection devices while permitting light rays directed toward said optical deflection devices to pass thereto;

wherein said support wall is disposed across said optical deflection devices so as to leave a passage between said optical deflection devices and a rear edge of said support wall, wherein said edge of said masking portion extends at these transverse ends in continuity with said rear edge of said support wall;

wherein said reflector includes a frame for supporting said optical deflection devices that includes at least one wall delimiting said optical deflection devices, and in that said edge of said masking portion is cut away to correspond to a given position of said at least one wall delimiting said optical deflection devices.

2. The lighting unit according to claim 1, wherein said reflector and said support wall are made integral.

3. The lighting unit according to claim 1, wherein said masking portion is disposed transversely at a center of said support wall.

4. The lighting unit according to claim 1, wherein said masking portion lies in a plane offset vertically, in a direction away from said emission devices, relative to the rest of said support wall.

5. The lighting unit according to claim 4, wherein said vertical direction of said offset plane is in the same overall direction of emission of said emission devices for emitting a luminous flux.

6. The lighting unit according to claim 1, wherein said edge of said edge of said masking portion is corrugated and said rear edge of said support wall is straight.

7. The lighting unit according to claim 1, wherein said edge of a central section has a corrugated shape.

8. The lighting unit according to claim 1, wherein said at least one wall delimiting said optical deflection devices include two walls that delimit said optical deflection devices laterally on either side and are joined perpendicularly to said support wall and a lower wall that is joined to a lower edge of said optical deflection devices, opposite said support wall, and wherein said masking portion has two lateral sections in which a cut-off edge extends in transverse continuity with a rear edge of said support wall and a central section offset longitudinally toward an interior of said support wall.

9. The lighting unit according to claim 7, wherein said edge of said central section has a corrugated shape, said corrugated shape of said edge of said central section is a function of a shape of a line joining the lower edge of said optical deflection devices and said lower wall of said support frame.

10. The lighting unit according to claim 1, wherein said support wall carries means for positioning said light emission devices.

11. The lighting unit according to claim 9, wherein said positioning means are integral with said support wall.

12. The lighting unit according to claim 9, wherein said positioning means include a pin projecting from said support wall for adjustment of a position of said light emission devices relative to said lighting unit in two perpendicular directions parallel to a plane of said support wall.

13. A motor vehicle headlamp including two lighting units according to claim 1 and wherein said two lighting units are disposed transversely side by side.

14. The lighting unit according to claim 2, wherein said masking portion is disposed transversely at a center of said support wall.

15. A lighting unit comprising:

a reflector; and emission devices for emitting a luminous flux in the direction of said reflector, said reflector comprising optical deflection devices for optical deflection of said flux toward an outlet of said lighting unit, said reflector including a support wall disposed across said optical deflection devices so as to be disposed between said optical deflection devices and said emission devices, said support wall including a masking portion that is disposed facing said emission devices and an edge of which is cut out so as to form a mask integral with said support wall adapted to allow to pass only a portion of the rays emitted by said emission devices, said masking portion being integrally formed in said support wall and having a cut-off edge that is adapted to block rays that are oriented or directed toward said optical deflection devices while permitting light rays directed toward said optical deflection devices to pass thereto;

wherein said support wall carries means for positioning said light emission devices;

wherein said positioning means include a pin projecting from said support wall for adjustment of a position of said light emission devices relative to said lighting unit in two perpendicular directions parallel to a plane of said support wall; and wherein said positioning means further include a stop projecting from said support wall for an adjustment in a third direction perpendicular to said two perpendicular directions, a height of said stop relative to said support wall being less than that of said pin.

16. A lighting unit comprising:

a reflector; and emission devices for emitting a luminous flux in the direction of said reflector, said reflector comprising optical deflection devices for optical deflection of said flux toward an outlet of said lighting unit, said reflector including a support wall disposed across said optical deflection devices so as to be disposed between said optical deflection devices and said emission devices, said support wall including a masking portion that is disposed facing said emission devices and an edge of which is cut out so as to form a mask integral with said support wall adapted to allow to pass only a portion of the rays emitted by said emission devices, said masking portion being integrally formed in said support wall and having a cut-off edge that is adapted to block rays that are oriented or directed toward said optical deflection devices while permitting light rays directed toward said optical deflection devices to pass thereto;

wherein said support wall carries means for positioning said light emission devices;

wherein said support wall carries means for fixing a heatsink adapted to cover said emission devices to cool same.

17. The lighting unit according to claim 16, wherein said fixing means are disposed at one transverse edge at least of said support wall while said positioning means are disposed in a vicinity of said masking portion or between the latter and said fixing means.

18. The lighting unit according to claim 17, wherein said lighting unit includes light emission devices.

19. The lighting unit according to claim 18, wherein said light emission devices are supported directly or indirectly by said support wall, either via a PCB or an element carrying said PCB.

* * * * *